United States Patent [19]

Seegmiller

[11] Patent Number: 4,960,348

[45] Date of Patent: Oct. 2, 1990

[54] TRUSS SYSTEMS, COMPONENTS AND METHODS FOR TRUSSING ARCHED MINE ROOFS

[76] Inventor: Ben L. Seegmiller, 3500 Loren Von Dr., Salt Lake City, Utah 84124

[21] Appl. No.: 281,467

[22] Filed: Dec. 8, 1988

[51] Int. Cl.[5] ..... E21D 20/00

[52] U.S. Cl. ..... 405/259; 405/288

[58] Field of Search ..... 405/259, 260, 261, 288; 299/11

[56] References Cited

U.S. PATENT DOCUMENTS

| | | | |
|---|---|---|---|
| 1,686,910 | 10/1928 | Frease . | |
| 3,427,811 | 2/1969 | White . | |
| 3,505,824 | 4/1970 | White . | |
| 4,349,300 | 9/1982 | Kelley | 405/288 |
| 4,395,161 | 7/1983 | Wilson et al. | 405/259 |
| 4,498,816 | 2/1985 | Korpela et al. | 405/259 |
| 4,596,496 | 6/1986 | Tyrell et al. | 405/288 |
| 4,630,974 | 12/1986 | Sherman | 405/288 |
| 4,632,605 | 12/1986 | Tucker | 405/259 |
| 4,666,344 | 5/1987 | Seegmiller | 405/259 |
| 4,749,310 | 6/1988 | White | 405/288 |
| 4,776,729 | 10/1988 | Seegmiller | 405/288 |

FOREIGN PATENT DOCUMENTS 1072893 6/1967 United Kingdom .

*Primary Examiner*—David H. Corbin

*Attorney, Agent, or Firm*—M. Ralph Shaffer

[57] ABSTRACT

A truss structure, components, and method for trussing arched roofs in mines and the like. The truss structure includes, in addition to specially designed brackets and tensioned elongate connectors, one or more medially positioned upstanding post brackets for upwardly abuting against central portions of an arched mine roof. The method and concept includes, in a preferred form, applying obtuse-angle-oriented elongate connectors such as tie rods, secured to a lower portion of a post bracket concerned such that, when said elongate connectors are tensioned, an upward thrust is applied to said post brackets, whereby to produce an increased compression zone in the roof rock above the arched roof. Like-constructed interlocking roof truss structures are also provided for both longitudinally and also tranversely trussing an arched mine roof.

16 Claims, 3 Drawing Sheets

TRUSS SYSTEMS, COMPONENTS AND METHODS FOR TRUSSING ARCHED MINE ROOFS

FIELD OF INVENTION

The present invention relates to truss systems, components thereof, and methods for supporting and retaining rock formations as are found in hardrock mines, underground caverns, storage vaults, passageways, and so forth. Problems are experienced currently, especially in hardrock mines, relative to appropriate trussing of arched mine roofs. The structure and methods of the present invention take cognisance of this and supply useful trussing structures and methods, and also a post-bracket design wherein trussing can be completed in a horizontal tensioning mode, or even in an obtuse angle mode, pointing downwardly, such that tensioning of the truss actually increases the compressiive force of the post-bracket of the truss against a chosen undersurface of the mine roof.

DESCRIPTION OF PRIOR ART

Certain prior art is currently known in connection with truss systems for mines, for example. Such prior art consists of the following:

| U.S. Pat. Nos. | |
|---|---|
| 1,686,910 | 4,596,496 |
| 3,427,811 | 4,630,974 |
| 3,505,824 | 4,632,605 |
| 4,349,300 | 4,666,344 |
| 4,395,161 | 4,699,547 |
| 4,498,816 | 4,776,729 |
| **Foreign Patent Documents** | |
| 405/288 | United Kingdom |

Bureau of Mines Publication "Evaluation of Roof Trusses, Phase I", prepared for United States Deptartment of Interior, Bureau of Mines, by Department of Civil Engineering, University of Pittsburg, summary report on U.S.D.M., grant No. G0166088, Feb. 28, 1979.

BRIEF DESCRIPTION OF INVENTION

Each of the above patents and the publication listed relate in general to the present invention in the provision of roof trusses and the manner of their securement to rock formations; none of the above cited art, however, teach the unique concept and structures as provided herein whereby, in such truss structure, method and components, there is provided a means for applying and even augmenting compressive force of a post bracket to a central or other area of a mine roof. Additionally, none of the prior art teaches the various ways of interlocking the system for arched roofs so as to maximize integrity of the trussing structure and its effectiveness of producing the function desired. At the outset, it is to be observed that the truss structure herein, the brackets, bracket combination, elongate members, post brackets, and so on, can be employed to support rock formations as in hardrock mines, and likewise can be used to support, in general, arched mine roofs, underground caves, tunnels, storage vaults, toxic waste repositories, underground power stations, caverns, and so forth. The principal usage of the methods, trusses and components as set forth herein is for supporting arched roofs as are found in igneous and metamorphic formations.

As to unique elements herein, the same include suitably designed end brackets and post brackets which are elongated appropriately so that the over-all trussing structure by way of the tie rods and/or elongate members connecting the various brackets can be in a horizontal plane or, even more effectively, arranged in an obtuse-angular disposition whereby tightening will tend to increase angle toward the horizontal (approximately 180 degrees) and thereby provide a thrusting effect upon the post bracket against the underside of the mine roof. In this way the concavity of the arched roof can be provided for in a very convenient manner.

The invention is extended not only as to singular transverse trusses, but also as to trussing systems which proceed along a substantial length, longitudinally, of the mine roof.

In sum, the tensioning of the angulated anchor bolts and the vertical rock bolts, and the intercoupling of the end brackets with the central bracket member, effects a compression-stressed zone above the roof contour, making such zone less likely to slough off. This is created through vector forces at the distal ends of the rock bolts and their orientation toward the force vectors of the end bracket proceeding essentially in a direction toward the distal ends of such rock bolts. Moreover, such compressive zone is greatly enhanced in integrity and force field through the inclusion of post brackets which can be further urged upwardly by virtue of the obtuse-angle orientation of end connectors which are tightened or tensioned to produce an upward force vector against the post brackets utilized.

OBJECTS

Accordingly, a principal object of the invention is to provide a new and improved truss for mine openings having arched roofs.

A further objected is to provide improved end brackets for mounting apertures in mine roofs whereby to maintain the positional integrity of such brackets.

A further object of the invention is to provide centrally located post brackets in tensioning systems for supporting raised areas of an arched mine roof.

An additional object is to provide methods for supporting arched roofs in mines.

BRIEF DESCRIPTION OF THE DRAWINGS

The present invention may best be understood by reference to the following description, taken in connection with the accompanying drawings in which.

DETAILED DESCRIPTION OF PREFERRED EMBODIMENTS

Figure 1:
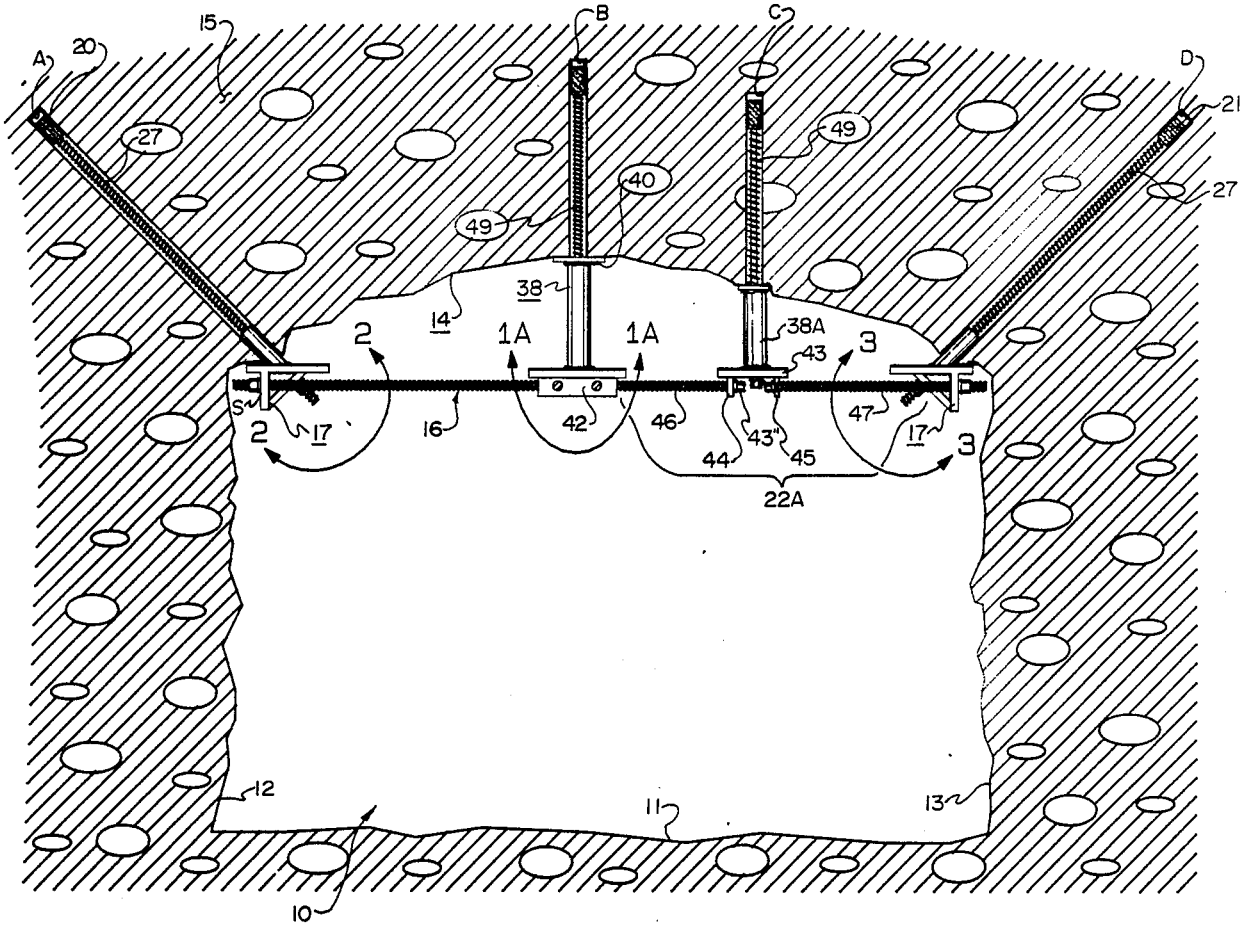
FIG. 1 is a front elevation of a mine tunnel proceeding through a rock formation, with trussing structure of the present invention being employed for installation in and support of the roof rock; for convenience of illustration, a portion of the structure is shown broken away and sectioned.

In FIG. 1 the mine opening 10 has a mine floor 11, ribs 12 and 13, and mine roof 14, which is overlaid by roof rock 15. It is noted that the mine roof 14 is upwardly arched, i.e. downwardly convex, as is commonly associated with rock material such as igneous or metamorphic rock, which are encountered in conventional hardrock mining. The trussing structure 16 includes a pair of end brackets 17 that are secured to opposite transverse extremities of the mine roof by means of respective anchor bolts 27 with their conventional epoxied ends, end fittings, and so forth, at 20 and 21.

The mounting of the anchor bolts and the associated structure proximate the extremities at 20 and 21 is strictly conventional.

End bracket 17 should now be described, see FIGS. 2–5. As is seen, each of the end brackets 17 includes a bearing plate 18 and a depending flange 19 welded or integral therewith. Flange 19 has a through-aperture 20 for receiving the end 21 of elongate connector 22. Elongate connector 22 may be tensioned by the inclusion of nut 23, having conventional spherical head 24 seated into the left-hand portion of aperture 20. An angular plate 25 is welded or otherwise secured to the lower portion of depending flange 19 and a bottom portion of bearing plate 18, the same including aperture 26 for the receipt of the lower portion of anchor bolt 27. Anchor bolt 27 may likewise be provided with a tensioning nut 28, having a spherical portion 29 seated into the lower region of aperture 26. Angular plate 25 may be reinforced by gusset portions 31 and 32, which are welded at 33 and 34 to the remainder of the structure.

Of special importance is the inclusion of an angulated aperture 35 through bearing plate 18 in which is received we seize the anchor bolt 27 in the manner indicated.

Integral with upper surface 36 of bearing plate 18 is a tubular insert 37, the latter being cut on the bias and welded at 38 to upper surface 36. It is seen relative to FIG. 4 that, in the usual case, the depending flange 19 will be provided with a pair of apertures 20 for accommodating the passage there-through of a pair of elongate connectors 22.

Figure 6:
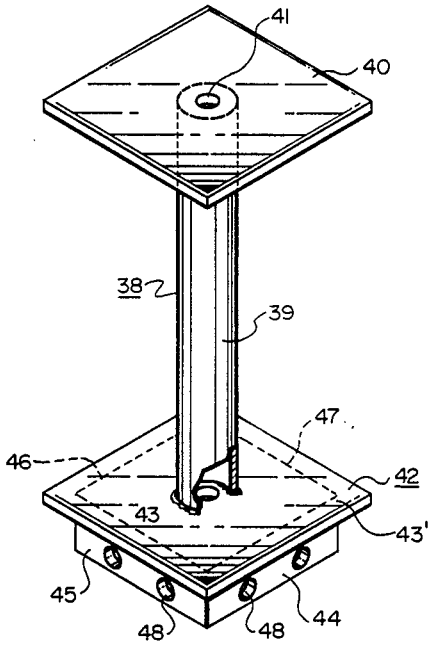
FIG. 6 is an enlarged perspective view of the post bracket centrally disposed in the trussing structure of FIG. 1.

Post bracket 38 in FIGS. 1 and 6 comprises an elongate, hollow post member 39, a bearing plate 40 secured thereto and provided with central aperture 41, and a securement portion 42, welded or otherwise secured at 43 to the lower extremity of post member 39.

Securement portion 42 includes an upper plate 43' and, depending therefrom, a series of welded or otherwise connected side flanges 44, 45, 46, and 47. Each of these side flanges will be provided with a series of apertures 48 for reception of tie rods or other suitable elongate connection members. In installation, bearing plate 40 abuts and thrusts against the upper central surface of the arched roof 14. As a practical matter, in installation, the anchor bolt and rock bolt apertures are drilled at A, B, C, and D, for example, and then the end brackets 17 are installed as indicated once the anchor bolts are in place and in secured condition. As to rock bolts 49, these are thrust home into drilled holes B and C, and suitable end fittings and/or epoxy are supplied for securing the upper extremities of these rock bolts in place. Subsequently, the post bracket is mounted over the rock bolt 49 and nut 50 is tightened down so as to place the post bracket in compression against the upper roof surface and, of course, the rock bolt itself in tension. The same will likewise occur at the hole or aperture C relative to rock bolt 49. The elongate connector, customarily referred to as elongate connector 22, can take the form shown at 22A in FIG. 1, where there is provided a segmented construction. In such event, the post bracket takes a form 38A, with the sole differences relative to post bracket 38 being that the post member is of reduced length; also, it is noted that the securement portion 42A this time includes a base flange 43 and simply a pair of depending flanges 44 and 45 secured thereto, each of such flanges being provided with appropriate apertures. Accordingly, a pair of tie rods may be used, two sets of tie rods as the case may be, for securing the securement portion of the central post bracket 38 ultimately to the right-hand end bracket 17. In such event, nuts 43" will be used at the innermost ends of the tie rods 46 and 47. The structure thus indicates that the elongate connector or connectors may comprise simply one or more tie rods which span completely the space between the securement portion of the central post bracket and the end bracket as, for example, the left end bracket 17 as seen in FIG. 1; or a series of tie rod lengths, for example, can be employed with the securement portion of bracket 38A for completing the tension span between the securement portion of the post bracket 38 and the right-hand end bracket 17.

Figure 7:
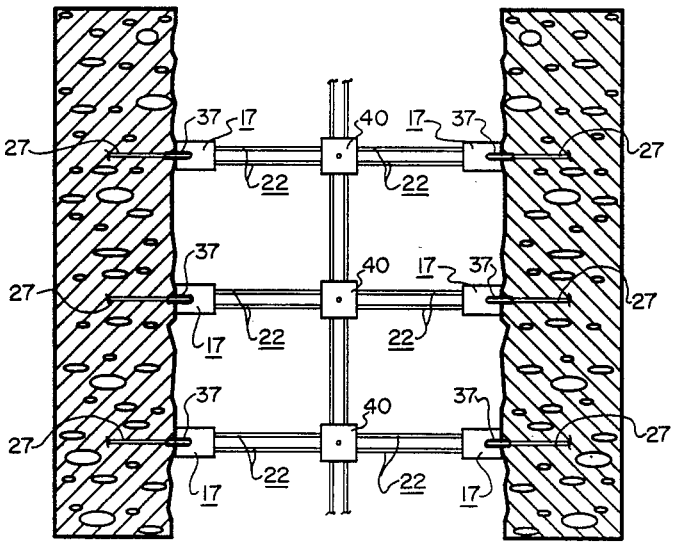
FIG. 7 is a top plan of the mine trussing structure, looking downwardly, with the roof rock being eliminated for purposes of clarity and showing the general configuration, by way of schematic design, of a mutually spaced series of pairs of end brackets and center post brackets, mutually coupled together to produce a trussing, longitudinally, of the roof of a mine opening.

FIG. 7 is a view looking downwardly of the completed trussing structure when a series of the same are mutually spaced longitudinally along and underneath a mine roof, with the post brackets being secured not only to their respective end brackets, but also to longitudinally adjacent post brackets. As seen in FIG. 7, a pair of tie rods or elongate connectors are coupled between the securement portions of the respective post brackets and the respective pairs of end brackets.

If desired, relative to FIG. 7, additional intermediate post brackets may be employed as, for example, the bracket 38A as seen in FIG. 1. Intermediate brackets may well be useful for accommodating long transverse spans in certain mine roof areas.

In the drawings and the description previously given, it is seen that the present invention provides a method for actively trussing an arched mine roof, having roof rock there-above. Broadly, such method includes the steps of: providing a pair of mutually spaced end brackets, each having a tubular insert and a reaction surface provided at least one elongate member receiving aperture. A subsequent step is to drill outwardly-angulated side-opposite apertures in said roof rock proximate transverse terminal regions of said arch roof; subsequently, there is a step of anchoring said tubular insert of each of said end brackets in a respective one of said apertures such that said reaction surfaces of said end brackets are essentially parallel. Subsequently, there is provided a vertical post bracket having at least one elongate member securement portion provided with receiving apertures; the, there is the step of compressively securing said post bracket against said roof rock proximate a central portion of said arch roof between said end brackets. Thereafter, there is provision made of elongate members protruding through and extending between said securement portion of said post bracket and said reaction services of said end brackets at the apertures thereof. Subsequently, there is a step of providing means for tensioning said elongate members; then, actually doing so, whereby to anchor and also tension said elongate members between said end brackets and said post bracket, said end brackets being in essentially a horizontal plane, said securement portion of said post bracket being below the space between such plane and the arched roof.

Figure 1A:
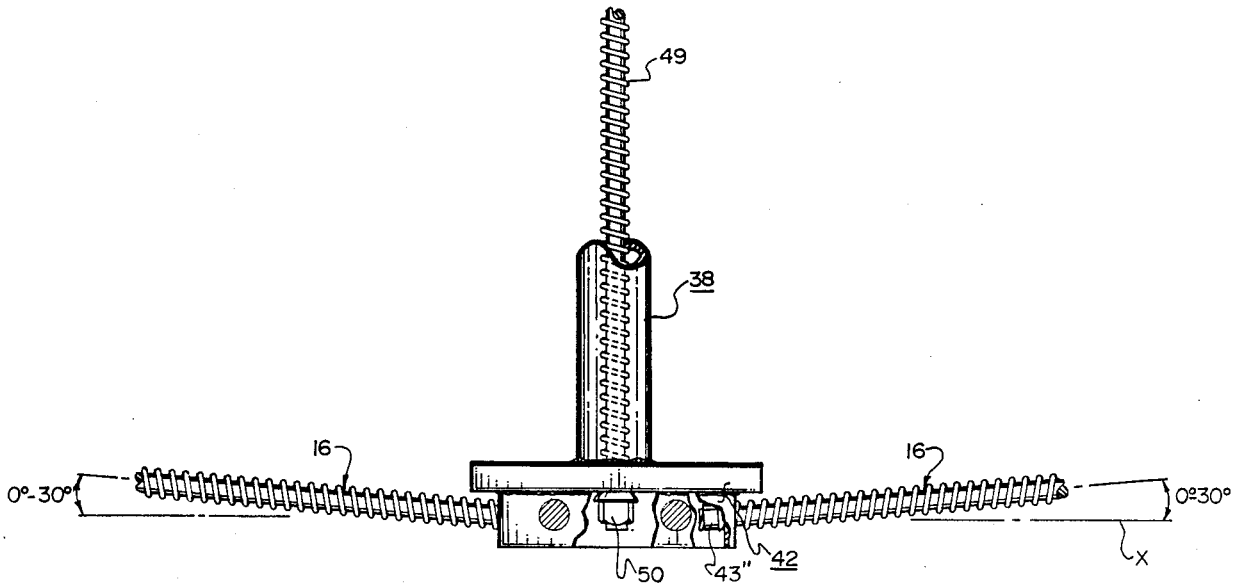
FIG. 1A is an enlarged detail of the central portion of the structure of FIG. 1, indicating the optional angular relationship that can be had as between the elongate connectors, coupled to the securement portion of the post bracket, and a horizontal line drawn through such bracket; this will be described fully hereinafter.
Figure 2:
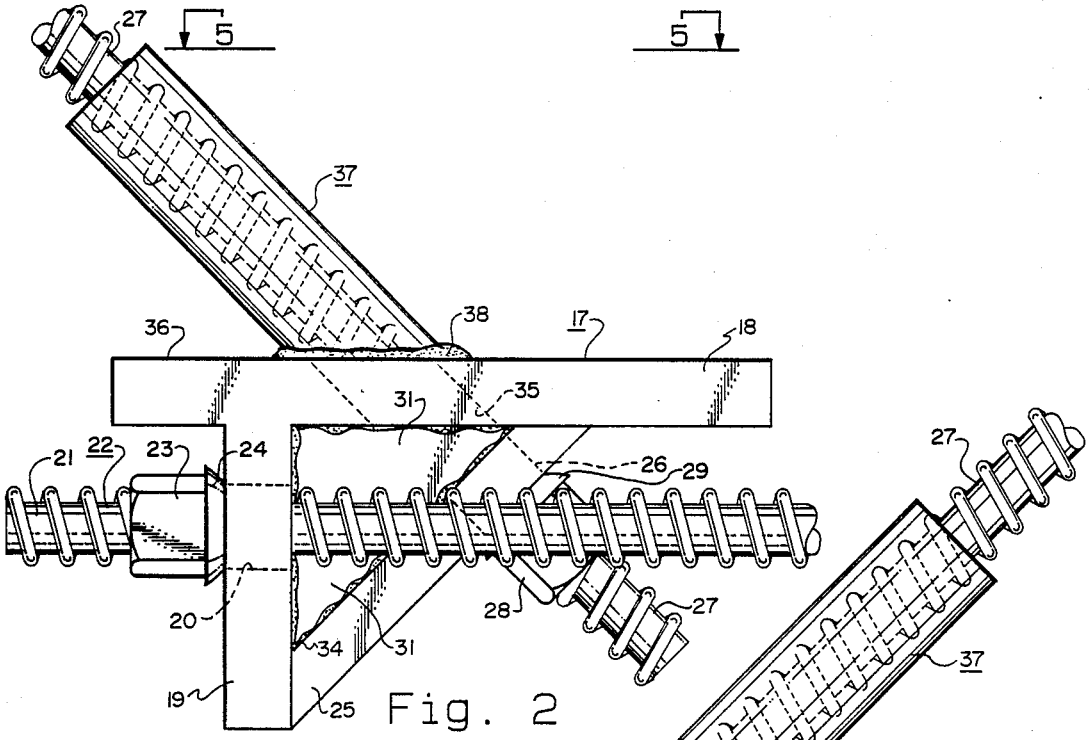
FIG. 2 is an enlarged side elevation of a representative end bracket used in the trussing structure of FIG. 1; it will be understood that opposite brackets be enjoined the same configurment as that seen in FIG. 2.
Figure 3:
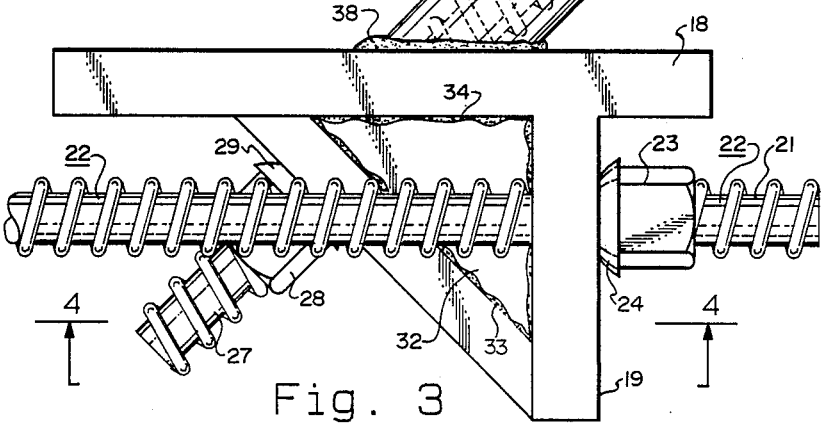
FIG. 3 is a rear elevation of the brackets seen in FIG. 2.
Figure 4:
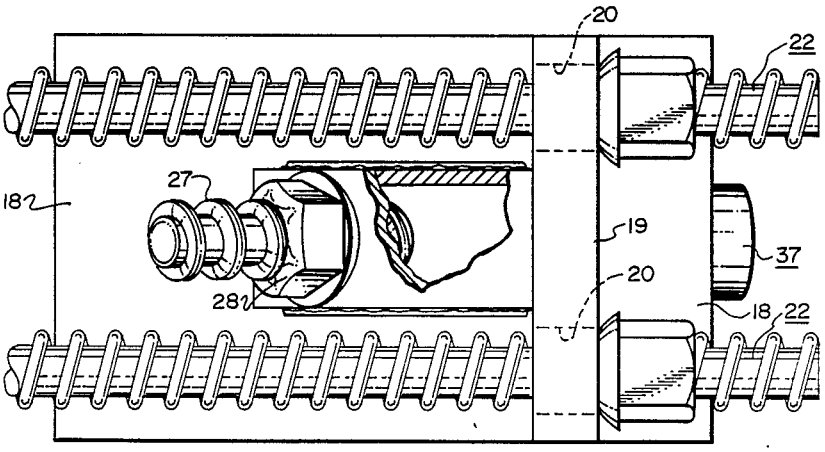
FIG. 4 is a bottom plan of the end bracket structure, associated rock bolt and elongate connectors, the end bracket design corresponding to that shown in FIGS. 2 and 3.

There are variations, of course, in connection with the method above described of the post bracket; subsequently, a step includes tightening or tensioning the rock bolt by nut means, for example, so as to bring the post bracket securely against the mine roof in an abutting relationship. Thereafter, or even before this step, there is presented the concept of tensioning the elongate member such as tie rods so that these not only tension the truss structure per se, but also provide a compressive force acting against the post bracket in an actual upward thrusting or upward lifting of the same by virtue of the tightening of the elongate members such as the tie rods shown in FIG. 1A. Actually, the nominal and even-torqued position of the elongate members or tie rods as at 16 in FIG. 1A, be anywhere from 0 to 30 degrees relative to a horizontal plane passing through the securement portion. This feature serves not only to tension appropriately the over-all truss structure but also, and equally importantly, to provide an upward thrusting force as to post support 38 against the area contacted by upward flange 40 so as to augment the compression zone in the roof rock accordingly, this will be seen in the drawings.

This augmentation is above and beyond the function set forth in column 6 of the inventor's above-mentioned patent No. 4,776,729. The entire disclosure of such patent is incorporated herein by way of reference.

In operation, as to the FIG. 1 embodiment, the anchor bolts and roof bolts are secured at their distal ends and are maintained in compression by the tightening down of the proximate nuts or other useful means relative to the opposite end brackets 17 and one or more post brackets as at 38 and 38A. The elongate member 16, whether 1, 2, or more in number at each location, intersecure the securement portion 42 of the respective post bracket with the depending flanges of the end bracket 17. The length of the post brackets can be such that all of the connectors are initially, and finally, in simply a horizontal plane. However, the augmentation of the force field in the roof rock, above the roof surface, can readily be achieved where the lengths of the post brackets, of whatever number, are enlarged slightly such that the condition in FIG. 1A exists, and wherein there is an initial angular relationship between the upwardly canted tie rods and the horizontal plane at X of from 0 to 30 degrees and preferably from 5 to 10 degrees. Thus, when this condition obtains, the tensioning of the tie rods or elongate members, as the case may be, will produce an upward thrusting of the post bracket to increase measurably the compression within the rock formation above the roof line and thereby increase the force field of the structure method as shown in the inventor's aforementioned U.S. Pat. No. 4,776,729.

An eminently practical step in supplying the elongate members is simply to provide threaded tie rods as indicated, with tensioning nuts at either extremity of the respective rods. This structure can obviously be modified to include any one of several end configurments whereby the elongate members, of whatever form, can be tensioned. One such approach is to forge one end of the elongate connectors to an "L" or "T" configurment; at the other end there will be positioned a collet or some suitable wedging structure whereby, after the tensioning of the particular elongate member, a means is used to retain such tension against a reaction surface such as surface S in FIG. 1. Quite obviously, the structure in FIG. 7 may include the additional post bracket 38A seen in FIG. 1; where such is the case either in FIG. 1 or FIG. 7 or similar structures, the entire elongate member or elongate connector will consist of the tie rods, for example, and also any inter-connecting structures such as the securement portion as at 42A relative to the post bracket 38A. FIG. 7 illustrates that, preferably, a pair of elongate connectors such as tie rods are used so as to preclude the inadvertent inclusion of force couples which might tend to distort the material under high torque conditions. The pairs of end brackets are serially arranged and mutually spaced, as indicated, and other elongate connectors or members such as tie rods may be used to complete the longitudinal character of the truss, whereby longitudinally adjacent post brackets may be tensioningly secured together.

Figure 5:
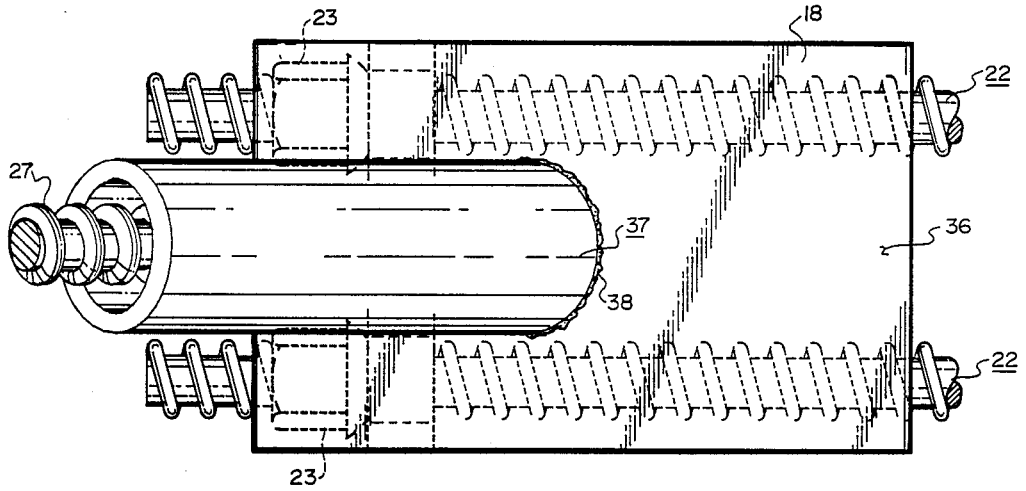
FIG. 5 is a top plan of the end bracket of FIG. 2.

While it is possible that the tubular insert as at 37 in FIG. 5 can be eliminated, the inclusion of the same is eminently desired; this is for the purpose of maintaining the structural integrity of the truss and, even more importantly, to ensure that the end brackets are properly mounted so that the reaction surfaces accommodating tie rod nuts or other tightening means can be maintained essentially vertical and mutually parallel, relative to opposite side end brackets. The method of trussing, thus, is laid out as previously given and also as enlarged upon through the structure clearly seen in FIG. 7. Further objects, operations and advantages are clearly set forth, not only in the specification above given and in the drawings, inherently, but also in the claims hereinafter set forth.

Therefore, while particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A method for actively trussing an upwardly concave, arched mine roof having roof rock thereabove, including the steps of: providing a pair of mutually spaced end brackets each having an outwardly and angularly extending hollow tubular insert and also a reaction surface provided at least one tie rod receiving aperture; drilling outwardly-angulated side-opposite apertures in said roof rock proximate transverse terminal regions of said arched roof; anchoring, by a respective anchor bolt passing through said tubular insert, said tubular insert of each of said end brackets in respective ones of said apertures such that said reaction surfaces of said end brackets are essentially parallel; providing a metallic, vertically-elongated vertical post bracket having at least one tie rod securement portion provided with tie rod receiving apertures; compressively securing and anchoring, by a separate anchor bolt passing through said post bracket, said post bracket against said roof rock proximate a central portion of said arched roof between said end brackets; providing tie rods protruding through and extending between said tie rod securement portion of said post bracket and said reaction surfaces of said end brackets at said apertures thereof; providing abutments and also tensioning means, for tensioning said tie rods, to said tie rods at opposite extremities thereof; and actuating said tensioning means whereby to anchor and tension said tie rods between said end brackets and said post bracket, said end brackets being in a horizontal plane, said securement portion of said post bracket being beneath the space between said plane and said arched roof.

2. The method of claim 1 wherein said securement portion is initially disposed nominally beneath said plane, whereby said tensioning step operates to further compressively thrust said post bracket against said arched roof by nominally reducing the distance of said securement portion of said post bracket beneath said plane.

3. The method of claim 2 wherein, when said tie rods are tensioned, said securement portion is brought into a co-planar position relative to said plane.

4. The method of claim 1 wherein said end brackets have canted apertured portions, said anchoring step including securing anchor bolts through said tubular inserts into said roof rock and securing reaction means to said tie rods and against said canted apertured portions for tensioning said anchor bolts.

5. A method for actively trussing an upwardly concave, arched mine roof having roof rock thereabove, including the steps of: providing a pair of mutually spaced end brackets each having an outwardly and angularly extending tubular hollow insert and also a reaction surface provided with a pair of tie rod receiving apertures; drilling outwardly-angulated sideopposite apertures in said roof strata proximate transverse terminal regions of said arched roof; anchoring said tubular insert of each of said end brackets, by an anchor bolt passing therethrough, in respective ones of said apertures such that said reaction surfaces of said end brackets are essentially parallel; providing a metallic, vertically-elongated, vertical post bracket having a tie rod securement portion provided with tie rod receiving apertures; compressively securing and anchoring, by a separate anchor bolt passing through said post bracket, said post bracket against said roof rock proximate a central portion of said arched roof between said end brackets; providing tie rods protruding through and extending between said tie rod securement portion of said post bracket and said reaction surfaces of said end brackets at said apertures thereof; providing abutments and also tensioning means for tensioning said tie rods, to said tie rods at opposite extremities thereof; and actuating said tensioning means whereby to anchor and tension said tie rods between said end brackets and said post bracket at said securement portion, said end brackets being in a horizontal plane, said securement portion of said post bracket being beneath the space between said plane and said arched roof.

6. A method for actively trussing an upwardly concave, arched mine roof having roof rock thereabove, including the steps of: providing a series of pairs of end brackets disposed in respective essentially horizontal planes, anchoring respective ones of each of said pairs to said roof rock proximate transverse terminal regions of said arched roof, said pairs of said series being mutually spaced along said roof in a longitudinal direction, providing a series of metallic, vertically-elongated vertical post brackets between respective ones of each of said pairs of end brackets, thrustingly securing and anchoring, by anchor bolts passing through respective ones of said post brackets, said post brackets against said roof, said post brackets and said end brackets including a series of apertures for receiving the ends of tie rods, providing a series of tie rods disposed through said apertures and having means for tensioning said tie rods to and between said vertical post brackets and their associated respective ones of said end brackets, and providing tensioned tie rod means for longitudinally intercoupling in tension said post brackets together, said post brackets being at least as long as to at least meet imaginary lines drawn through respective sets of end brackets.

7. The method of claim 6 wherein, as to each post bracket, the inner extremities of transversely positioned tie rods being secured to a respective post bracket, and proceeding from their respective end brackets, are at positions nominally lower than the horizontal plane passing through the respective end bracket pair, whereby the tensioning of all of said transverse tie rods will add further compressive thrust to said post brackets at the central roof areas which they engage.

8. An anchor-bolt-receiving end bracket for installation in rock formations in mines and the like including, in combination, a bearing plate, a flange depending from and integral with said bearing plate and provided with connector apertures, an angular plate integral with said bearing plate and said flange and having a reaction surface, said angular plate and said bearing plate having respective angularly aligned apertures enjoying a common axis which is less than 90 degrees relative to said bearing plate, said bearing plate being provided with an anchor-bolt-receiving, hollow tubular insert extending outwardly from and angularly with respect to said bearing plate and being interiorly aligned essentially with said angularly aligned apertures of said bearing plate and angular plate.

9. The structure of claim 8 wherein said tubular insert is cylindrical, having a longitudinal axis aligned with said common axis, said tubular insert being provided whereby to be thrust into a rock formation aperture and thereby appropriately position said end plate in its mounting to said rock formation.

10. A unitary post bracket for mine trusses, including, in combination: an upstanding hollow elongate post member having upper and lower ends, a transverse bearing plate secured to said upper end and having an aperture communicating with the interior of said post member, a securement portion apertured for the receipt of connectors and secured to said lower end, said securement portion providing access to the interior of said post member, whereby to permit the inclusion of an external anchor bolt through said post member and said bearing plate, for anchoring said post bracket to an external rock formation.

11. The structure of claim 10 wherein said securement portion comprises a base plate and apertured connector-receiving flanges secured to and depending from said base plate.

12. A truss for supporting an arched mine roof having a rock formation overlay, said truss including, in combination, a pair of opposite end brackets secured to said rock formation, an essentially vertical, hollow, elongate, metallic post bracket thrustingly engaging said mine roof at a position between said end brackets, a separate anchor bolt passing through said post bracket for anchoring said post bracket against said mine roof, and respective elongate structures tensioningly engaging and secured to said post bracket and respective ones of said end brackets.

13. The structure of claim 12 wherein said elongate structures mutually form an obtuse angle, pointing downwardly, whereby their respective tensioning will supply an upward thrust to said post bracket to which they are secured.

14. The structure of claim 12 wherein post bracket is provided with a tensioned rock bolt for effecting initial compressive securement of said post bracket to said rock formation of said mine roof.

15. The structure of claim 12 wherein said post bracket includes lower depending flanges provided apertures for receiving and securing said elongate structures at respective extremities thereof.

16. The structure of claim 12 wherein said end brackets having upwardly and outwardly oriented tubular insert means which, when positioned in askew apertures of an external roof rock formation, will operate to desirably position said end brackets for elongate connector attachment, said end brackets being provided with tensioning anchor bolts proceeding through said tubular insert means into said rock formation.

* * * * *